US008891777B2

(12) United States Patent
Gran et al.

(10) Patent No.: US 8,891,777 B2
(45) Date of Patent: Nov. 18, 2014

(54) HEARING AID WITH SIGNAL ENHANCEMENT

(75) Inventors: Karl-Fredrik Johan Gran, Malmö (SE); Andrew Burke Dittberner, Antioch, IL (US)

(73) Assignee: GN Resound A/S, Ballerup (DK)

( * ) Notice: Subject to any disclaimer, the term of this patent is extended or adjusted under 35 U.S.C. 154(b) by 141 days.

(21) Appl. No.: 13/343,428

(22) Filed: Jan. 4, 2012

(65) Prior Publication Data

US 2013/0170653 A1 Jul. 4, 2013

(30) Foreign Application Priority Data

Dec. 30, 2011 (DK) ..... 2011 70772
Dec. 30, 2011 (EP) ..... 11196247

(51) Int. Cl.
*H04R 5/00* (2006.01)
*H04R 25/00* (2006.01)

(52) U.S. Cl.
USPC ..... 381/23.1; 381/317

(58) Field of Classification Search
USPC ..... 381/23.1, 313, 317, 318, 94.1, 17, 18; 704/226, 233
See application file for complete search history.

(56) References Cited

U.S. PATENT DOCUMENTS

| | | | | |
|---|---|---|---|---|
| 6,449,586 | B1 * | 9/2002 | Hoshuyama | 702/190 |
| 7,120,258 | B1 | 10/2006 | Burleigh et al. | |
| 2006/0093172 | A1 | 5/2006 | Ludvigsen et al. | |
| 2010/0135500 | A1 * | 6/2010 | Derleth et al. | 381/23.1 |

FOREIGN PATENT DOCUMENTS

| | | | |
|---|---|---|---|
| EP | 1 879 426 | A2 | 1/2008 |
| JP | 2007336460 | | 12/2007 |
| WO | 02/03749 | A2 | 1/2002 |
| WO | 02/07479 | A1 | 1/2002 |
| WO | WO 2004100607 | | 11/2004 |
| WO | 2007/137364 | A1 | 12/2007 |
| WO | 2008/083712 | A1 | 7/2008 |

OTHER PUBLICATIONS

Extended European Search Report dated Jun. 18, 2012 for EP Patent Application No. 11196247.8.
1st Technical Examination and Search Report dated Jun. 29, 2012 for Danish Patent Application No. PA 2011 70772.
Second Technical Examination dated Apr. 16, 2013 for Danish Patent Application No. PA 2011 70772.

(Continued)

*Primary Examiner* — Curtis Kuntz
*Assistant Examiner* — Sunita Joshi
(74) *Attorney, Agent, or Firm* — Vista IP Law Group, LLP

(57) ABSTRACT

A method of binaural signal enhancement in a binaural hearing aid system, includes providing at least one microphone audio signal in response to sound, providing an estimate of one of a target signal and a noise signal based on the at least one microphone audio signal, phase shifting the estimate of one of the target signal and the noise signal, providing a phase shifted signal in which the phase shifted estimate of one of the target signal and the noise signal substantially substitutes the respective one of the target signal and the noise signal, transmitting a first signal representing the phase shifted signal towards a first eardrum of a user of the binaural hearing aid system, and transmitting a second signal representing the at least one microphone audio signal towards a second eardrum of the user. A system for performing the method is also described.

24 Claims, 7 Drawing Sheets

(56) References Cited

OTHER PUBLICATIONS

Office Action for JP Patent Application No. 2012-279605, dated Feb. 4, 2012 (5 pages).

European Communication pursuant to Article 94(3) EPC dated Aug. 27, 2014 for related EP Patent Application No. 11196247.8, 6 pages.

Meister, H., et al., "Messsystem zur Erfassung der, "binaural masking level difference" (BMLD) bei Kindern" ("A measurement system for assessing binaural masking level difference (BMLD) in children") HNO, vol. 53, No. 8, Jan. 29, 2005, XP019319798, 6 pages.

* cited by examiner

HEARING AID WITH SIGNAL ENHANCEMENT

RELATED PATENT APPLICATION

This application claims priority to, and the benefit of, Danish Patent Application No. PA 2011 70772, filed on Dec. 30, 2011, pending, and European Patent Application No. 11196247.8, filed on Dec. 30, 2011, pending, the entire disclosures of both of which are expressly incorporated by reference herein.

FIELD

A new binaural hearing aid system is provided that compensates for a hearing impaired user's loss of ability to understand speech in noise.

BACKGROUND

Hearing impaired individuals often experience at least two distinct problems: a hearing loss, which is an increase in hearing threshold level, and a loss of ability to understand high level speech in noise in comparison with normal hearing individuals. For most hearing impaired patients, the performance in speech-in-noise intelligibility tests is worse than for normal hearing people, even if the audibility of the incoming sounds is restored by amplification. An individual's speech reception threshold (SRT) is the signal-to-noise ratio required in a presented signal to achieve 50 percent correct word recognition in a hearing in noise test.

Today's digital hearing aids that use multi-channel amplification and compression signal processing can readily restore audibility of amplified sound for a hearing impaired individual. The patient's hearing ability can thus be improved by making previously inaudible speech cues audible.

Loss of capability to understand speech in noise is accordingly the most significant problem of most hearing aid users today. The traditional way of increasing SRT in hearing instruments, is to apply either beamforming or spectral subtraction techniques.

In the first case, at least one microphone in combination with a number of filters, fixed or adaptive, is used to enhance a signal from the presumed target direction and at the same time suppress all other signals.

In spectral subtraction techniques, the goal is to create an estimate of the long term noise spectrum and turn down gain in frequency bands where the instantaneous target signal power is lower than the long term noise power. Even though the methods are very different from a technological standpoint, they still have the common goal; enhance the target signal and remove the noise disturbance.

The methods cannot take listener intent into account and they may remove parts of the audio signal which the listener is trying to focus on.

SUMMARY

Below, a new method of enhancement of a desired signal is disclosed. The new method makes use of the human auditory system's capability of concentrating on a desired signal. A new binaural hearing aid system using the new method is also disclosed.

Listening in complex sound fields is to a large extent facilitated by binaural processing in the auditory system. Due to diffraction effects by the pinna, concha, head and torso and due to reflection effects in reverberant environments, cues are imparted to the sound field, which are highly individual for the given subject.

The most important cues in binaural processing are the interaural time differences (ITD) and the interaural level differences (ILD). The ITD results from the difference in distance from the source to the two ears. This cue is primarily useful up till approximately 1.5 kHz and above this frequency the auditory system can no longer resolve the ITD cue.

The level difference is a result of diffraction and is determined by the relative position of the ears compared to the source. This cue is dominant above 2 kHz but the auditory system is equally sensitive to changes in ILD over the entire spectrum.

It has been argued that hearing impaired subjects benefit the most from the ITD cue as the hearing loss tends to be less severe in the lower frequencies.

It has been shown that manipulating the relative interaural phase and level of a target signal, i.e. a signal a listener desires to listen to, and of a noise signal, i.e. a signal the listener perceives as disturbing, can improve speech intelligibility significantly. It seems as if the auditory system is indeed adapted to separate signals with different ITD and ILD encoding to perform a natural type of noise reduction to facilitate focusing on the target signal.

It has been found that if the target signal is presented in anti-phase, i.e. phase shifted 180°, and the noise in-phase in the two ears, an increase of the Binaural Masking Level Difference (BMLD) of 13 dB can be achieved compared to when both signals are presented in-phase in the two ears. Depending on the type of noise, an improvement of 20 dB of the BMLD is achievable.

The reverse situation where noise is presented out of phase and the target is presented in phase yields a slightly lower performance.

In the new method, at least one of the target signal and the noise signal is estimated, and the at least one estimate is presented to the user of the binaural hearing aid system in such a way that a user's capability of understanding speech in noise is improved.

For example, a listener may listen to sound with a signal S that the listener desires to listen to and noise N that the listener finds disturbing, i.e. the sound signal is S+N. Based on the sound signal S+N, the desired signal S may be estimated. The estimate is denoted ES. Subtracting two times the estimate ES from the sound signal S+N results in a modified signal: S+N−ES−ES, and since ES is approximately equal to S, modified signal is: N−ES which is approximately equal to −S+N, i.e. the original sound signal wherein the desired signal S has been substantially substituted with signal S phase shifted by 180°. Now, the original signal S+N may be presented to one ear of a user, and the phase shifted signal N−ES, or more accurately S+N−2ES, may be presented to the other ear for improved BMLD and SRT.

Alternatively, both the desired signal S and the noise N may be estimated and the sum of the estimates ES+EN may be presented to one ear of the user, and the phase shifted sum −ES+EN may be presented to the other ear for improved BMLD and SRT.

The desired signal S and the noise may be swapped so that the noise estimated is phase shifted instead of the desired signal for improved BMLD and SRT; however with decreased performance compared to phase shifting the desired signal S.

Noise can be background speech, restaurant clatter, music (when speech is the desired signal), traffic noise, etc.

The purpose for the method is not to remove any part of the signal but instead present the signals so that the auditory system can perform natural noise reduction and separate the target signal from the noise signal.

In this way, if for some reason (e.g. the presumed target direction is wrong, or the unit is not able to achieve sufficient target/noise separation, the target signal and the noise signal are swapped; enhancement of the target signal is still obtained, although with slightly decreased performance.

This would not be possible with traditional noise reduction techniques, since the target signal, which in this case would be assumed to be the noise would be suppressed.

Thus, a new binaural hearing aid system is provided, comprising at least one microphone for provision of respective at least one microphone audio signal in response to sound received at the at least one microphone, a signal separation unit configured to provide an estimate of one of a target signal and a noise signal based on the at least one microphone audio signal, a phase shift circuit configured to phase shift the estimate of one of the target signal and the noise signal, and a phase shift adder connected to provide a phase shifted signal representing sound received at the at least one microphone in which the estimate of one of the target signal and the noise signal has substantially substituted the respective original one of the target signal and the noise signal, and a first receiver for conversion of a receiver input signal into an acoustic signal for transmission towards one of the eardrums of a user of the binaural hearing aid system, and a second receiver for conversion of a receiver input signal into an acoustic signal for transmission towards the other one of the eardrums of the user, and wherein the receiver input of one of the first and second receivers is connected to a signal representing the phase shifted signal, and the receiver input of the other one of the first and second receivers is connected to a signal representing sound received at the at least one microphone.

Further, a new method is provided of binaural signal enhancement in a binaural hearing aid system, the method comprising the steps of providing at least one microphone audio signal in response to sound, and providing an estimate of one of a target signal and a noise signal based on the at least one audio signal, phase shifting the estimate of one of the target signal and the noise signal, and providing a phase shifted signal representing the at least one microphone audio signal in which the phase shifted estimate of one of the target signal and the noise signal has substantially substituted the respective original one of the target signal and the noise signal, and transmitting a signal representing the phase shifted signal towards one of the eardrums of a user of the binaural hearing aid system, and transmitting a signal representing the at least one microphone audio signal towards the other one of the eardrums of the user.

In the event that the estimate of one of the target signal and the noise signal is equal to the corresponding original one of the target signal and the noise signal, the phase shifted estimate can exactly substitute the respective original signal; however typically, the estimate of a signal will deviate from the original signal and substitution of the original signal with its estimate will typically not lead to substitution of the deviation, and thus the estimate is said to substantially substitute the original signal.

Throughout the present disclosure, one signal is said to represent another signal when the one signal is a function of the other signal, for example the one signal may be formed by analogue-to-digital conversion, or digital-to analogue conversion of the other signal; or, the one signal may be formed by conversion from another acoustic signal to an electronic signal or vice versa; or the one signal may be formed by analogue or digital filtering or mixing of the other signal; or the one signal may be formed by transformation, such as frequency transformation, etc, of the other signal; etc.

Further, signals that are processed by specific circuitry, e.g. in a signal processor, may be identified by a name that may be used to identify any analogue or digital signal forming part of the signal path from the source of the signal in question to an input of the circuitry, e.g. signal processor, in question. For example an output signal of a microphone, i.e. the microphone audio signal, may be used to identify any analogue or digital signal forming part of the signal path from the output of the microphone to its input to the signal processor, including pre-processed microphone audio signals.

The at least one microphone may contain a single microphone; however preferably, the at least one microphone has two microphones. Further, the at least one microphone may have more than two microphones for improved separation of the target signal and the noise signal.

For improved signal enhancement, the second hearing aid may also comprise at least one microphone for provision of microphone audio signals in response to sound received at the respective microphones. In this case, the transceiver of the first hearing aid is connected for reception of signals representing the microphone audio signals of the second hearing aid, and the signal separation unit is configured to provide the estimate of the target signal and the estimate of the noise signal based on the audio signals of the first and second hearing aids.

Preferably, the phase shift circuit phase shifts the estimate of the target signal, and preferably, the phase shift ranges from 150° to 210°, more preferred the phase shift is approximately equal to 180°, and most preferred equal to 180°.

The signal separation unit may be configured to provide the estimates based on spectral characteristics of the audio signals as is well-known in the art of noise reduction. However, according to the new method, the noise estimate is not suppressed in the output presented to the user; rather the target estimate and the noise estimate is presented to the user in a way that improves the user's SRT.

The signal separation unit may be configured to provide the estimates based on statistical characteristics of the audio signals as is well-known in the art of noise reduction. However, according to the new method, the noise estimate is not suppressed in the output presented to the user; rather the target estimate and the noise estimate is presented to the user in a way that improves the user's SRT.

The signal separation unit may comprise a beamformer, and the beam former may be configured to provide the estimates based on microphone audio signals of the first and second hearing aids. The beamformer of the signal separation unit is different from conventional beamformers in that the noise estimate is not suppressed in the output presented to the user; rather the target estimate and the noise estimate is presented to the user in a way that improves the user's SRT.

The beamformer combines the microphone audio signals output by a plurality of microphones of the at least one microphone into a target signal with varying sensitivity to sound sources in different directions in relation to the plurality of microphones. Throughout the present disclosure, a plot of the varying sensitivity as a function of the direction is denoted the directivity pattern. Typically, a directivity pattern has at least one direction wherein the microphone signals substantially cancel each other. Throughout the present disclosure, such a direction is denoted a null direction. A directivity pattern may comprise several null directions depending on the number of microphones in the plurality of microphones and depending on the signal processing.

The beamformer may be a fixed beamformer with a directional pattern that is fixed with relation to the head of the user. The beamformer may for example be based on at least two microphones, with a directional pattern that has a maximum in the front direction of the user, i.e. the forward looking direction of the user, and a null in the opposite direction, i.e. the rear direction of the user.

The beamformer may be based on more than two microphones, and may include microphones of both hearing aids using wireless or wired communication techniques. The increased distance between the microphones may be utilized to form a directional pattern with a narrow beam providing improved spatial separation of the target estimate from the noise estimate. The conventional output of the beamformer may be used as the target estimate, and the noise estimate may be provided by subtraction of the target estimate from the microphone audio signal of one of the microphones of the plurality of microphones.

When microphones of both hearing aids of the binaural hearing aid system cooperate with the beamformer, the respective microphone signals must be sampled substantially synchronously. Time shifts as small as 20-30 μS between sampling instants of the respective microphone signals in the two hearing aids may lead to a perceivable shift in the beam direction. Furthermore, a slowly time varying time shift between the sampling instants of the respective microphone signals, which inevitably will occur if the hearing aids are operated asynchronously, will result in an acoustic beam that appears to drift and focus in alternating directions.

Thus, the hearing aids of the binaural hearing aid system may be synchronized as for example discloses in more detail in WO 02/07479.

The beamformer may comprise adaptive filters configured to filter respective microphone audio signals and to adapt the respective filter coefficients for adaptive beamforming towards a sound source. For example, the beamformer may adapt to optimize the signal to noise ratio.

An adaptable beamformer makes it possible to focus on a moving sound source or to focus on a non-moving sound source, while the user of the hearing aid system is moving. Furthermore, the adaptable beamformer is capable of adapting to changes in the sound environment, such as appearance of a new sound source, disappearance of a noise source or movement of noise sources relative to the user of the hearing aid system.

An adaptive beamformer may be designed under the assumption that the signals received at the at least one microphone can be modelled as a combination of a target signal from a pre-determined target direction plus noise:

$$y_i(n)=h_i(n)*s(n)+v_i(n)$$

where $h_i(n)$ is the impulse response of sound propagation from the source emitting the signal s(n) to the $i^{th}$ microphone and $v_i(n)$ is the noise signal at the same microphone. The noise can consist of both directional noise and other types of noise such as diffuse noise or babble noise.

The filter coefficients may adaptively be determined by solving the following optimization problem:

$$\{a_i(n)\}_{i=1}^{4} = \arg \min_{\{a_i(n)\}_{i=1}^{4}} \|z(n)\|^2$$

$$\text{subject to } \sum_{i=1}^{4} a_i(n) * h_i(n) = h_1(n)$$

Finding a solution to this optimization could be done adaptively using least mean square, recursive least square, steepest descent or other types of numerical optimization algorithms.

Once the target and noise estimate has been determined, the signals are presented to the user in such a way that the SRT of the user is improved.

Preferably, the target estimate is presented in opposite phase, i.e. 180° phase shifted with relation to each other, at the two ears of the user, while the noise estimate is presented in phase at the two ears of the user. Thus, in the first hearing aid, a first adder may be connected to the signal separation unit, and output a sum of the target estimate and the noise estimate provided by the signal separation unit, and the output of the first adder may be connected to a signal processor for further processing, such as hearing loss compensation, and the output of the signal processor may be connected to an output transducer that outputs a corresponding output to one ear of the user, or the output of the first adder may be connected directly to the output transducer. A second adder may be connected to the signal separation unit, and output a sum of the reverse phases target estimate and the noise estimate provided by the signal separation unit, and the output of the second adder is connected to a transceiver that transmits the output of the second adder to the other hearing aid having a transceiver for reception of the output of the second adder. The output of the transceiver may be connected to a signal processor for further processing, such as hearing loss compensation, and the output of the signal processor may be connected to an output transducer that outputs a corresponding output to another ear of the user, or the output of the transceiver may be connected directly to the output transducer.

Instead, with somewhat reduced performance in improved SRT of the user, the noise signal may be presented in opposite phase, i.e. 180° phase shifted with relation to each other, at the two ears of the user, while the target estimate is presented in phase at the two ears of the user.

Preferably, the first hearing aid includes a delay between the adder and the output transducer so that the relative phase of the signals output by the respective output transducers of the first and second hearing aids is maintained.

The improvement of SRT as a function of the phase shift has a maximum at 180'; however the function is sine-shape with a flat maximum so that the improvement obtained by a phase shift ranging from 150° to 210° is close to the maximum improvement. Thus, the phase shift need not be exactly 180°, but preferably has a value within the range from 135° to 225°, more preferred from 150° to 210°.

The new binaural hearing aid system may comprise a multi-channel first hearing aid in which the microphone audio signals are divided into a plurality of frequency channels.

Correspondingly, individual target signal estimates and noise estimates may be provided in each frequency channel of the plurality of frequency channels, or may be provided in one or more selected frequency channels of the plurality of frequency channels, or one or more target signal estimates and noise estimates may be provided for one or more respective groups of selected frequency channels of the plurality of frequency channels, or one target signal estimate and noise estimate may be provided based on all the frequency channels of the plurality of frequency channels.

The plurality of frequency channels may include warped frequency channels, for example all of the frequency channels may be warped frequency channels.

The new binaural hearing aid system may additionally provide circuitry used in accordance with other conventional methods of hearing loss compensation so that the new circuitry or other conventional circuitry can be selected for operation as appropriate in different types of sound environment. The different sound environments may include speech, babble speech, restaurant clatter, music, traffic noise, etc.

The new binaural hearing aid system may for example comprise a Digital Signal Processor (DSP), the processing of which is controlled by selectable signal processing algorithms, each of which having various parameters for adjustment of the actual signal processing performed. The gains in each of the frequency channels of a multi-channel hearing aid are examples of such parameters.

One of the selectable signal processing algorithms operates in accordance with the new method.

For example, various algorithms may be provided for conventional noise suppression, i.e. attenuation of undesired signals and amplification of desired signals.

Microphone audio signals obtained from different sound environments may possess very different characteristics, e.g. average and maximum sound pressure levels (SPLs) and/or frequency content. Therefore, each type of sound environment may be associated with a particular program wherein a particular setting of algorithm parameters of a signal processing algorithm provides processed sound of optimum signal quality in a specific sound environment. A set of such parameters may typically include parameters related to broadband gain, corner frequencies or slopes of frequency-selective filter algorithms and parameters controlling e.g. knee-points and compression ratios of Automatic Gain Control (AGC) algorithms.

Signal processing characteristics of each of the algorithms may be determined during an initial fitting session in a dispensers office and programmed into the new binaural hearing aid system in a non-volatile memory area.

The new binaural hearing aid system may have a user interface, e.g. buttons, toggle switches, etc, of the hearing aid housings, or a remote control, so that the user of the new binaural hearing aid system can select one of the available signal processing algorithms to obtain the desired hearing loss compensation in the sound environment in question.

The new binaural hearing aid system may be capable of automatically classifying the users sound environment into one of a number of sound environment categories, such as speech, babble speech, restaurant clatter, music, traffic noise, etc, and may automatically select the appropriate signal processing algorithm accordingly as known in the art.

In accordance with some embodiments, a binaural hearing aid system includes at least one microphone for provision of at least one microphone audio signal in response to sound received at the at least one microphone, a signal separation unit configured to provide an estimate of one of a target signal and a noise signal based on the at least one microphone audio signal, a phase shift circuit configured to phase shift the estimate, a phase shift adder connected to provide a phase shifted signal, wherein in the phase shifted signal, the phase shift of the estimate of one of the target signal and the noise signal substantially substitutes respective one of the target signal and the noise signal, a first receiver for conversion of a first receiver input signal into a first acoustic signal for transmission towards a first eardrum of a user of the binaural hearing aid system, and a second receiver for conversion of a second receiver input signal into a second acoustic signal for transmission towards a second eardrum of the user, wherein a receiver input of one of the first and second receivers is connected to a signal representing the phase shifted signal, and a receiver input of the other one of the first and second receivers is connected to a signal representing the sound received at the at least one microphone.

In accordance with other embodiments, a method of binaural signal enhancement in a binaural hearing aid system, includes providing at least one microphone audio signal in response to sound, providing an estimate of one of a target signal and a noise signal based on the at least one microphone audio signal, phase shifting the estimate of one of the target signal and the noise signal, providing a phase shifted signal in which the phase shifted estimate of one of the target signal and the noise signal substantially substitutes the respective one of the target signal and the noise signal, transmitting a first signal representing the phase shifted signal towards a first eardrum of a user of the binaural hearing aid system, and transmitting a second signal representing the at least one microphone audio signal towards a second eardrum of the user.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
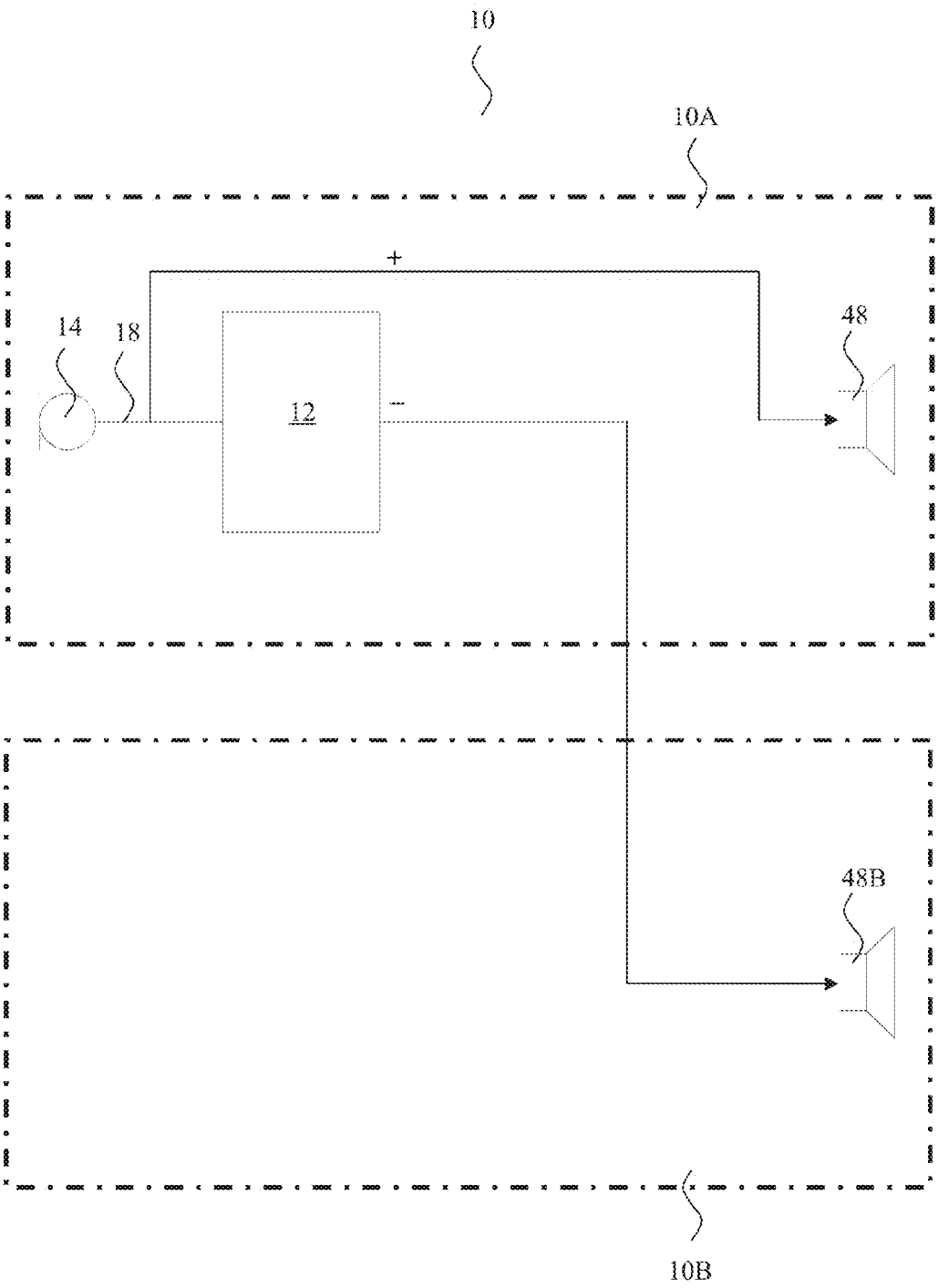
FIG. 1 schematically illustrates an exemplary new binaural hearing aid system, FIG. 2 schematically illustrates an exemplary new binaural hearing aid system, FIG. 3 schematically illustrates an exemplary new binaural hearing aid system, FIG. 4 schematically illustrates an exemplary new binaural hearing aid system, FIG. 5 schematically illustrates a signal separation unit with an adaptive beamformer based on two microphones, FIG. 6 schematically illustrates a signal separation unit based on four microphones, and FIG. 7 schematically illustrates an exemplary new binaural hearing aid system.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 schematically illustrates an example of the new binaural hearing aid system 10.

The new binaural hearing aid system 10 has first and second hearing aids 10A, 10B. The second hearing aid 10B has a receiver 48B and a transceiver (not shown) for reception of the input signal to the receiver 48B from the first hearing aid 10A by wired or wireless transmission. Thus, in the illustrated example, the acoustic output signal emitted by the second hearing aid 10B is controlled by the first hearing aid 10A.

The first hearing aid 10A comprises one microphone 14 for provision of microphone audio signal 18 in response to sound received at the microphone 14. The microphone audio signal 18 may be pre-filtered in respective pre-filters (not shown) well-known in the art, and input to the signal separation unit 12. The signal separation unit 12 estimates the target signal and subtracts two times the estimated target signal from the microphone audio signal 18 to obtain a signal, in the following denoted "the phase shifted signal", representing the microphone audio signal 18; however, wherein the original target signal has been replaced by the estimate of the target signal phase shifted by 180°. The phase shifted signal is output to a transceiver (not shown) in the first hearing aid 10A for transmission to the second hearing aid 10B. A receiver 48 of the first hearing aid 10A converts the microphone audio signal 18 into an acoustic signal for transmission towards the eardrum of one ear of the user, and the receiver 48B of the second hearing aid 10B converts the phase shifted signal into an acoustic signal for transmission towards the eardrum of the other ear of the user thereby improving BMLD and SRT. The signal separation unit 12 may be configured to provide the estimate based on time-domain, spectral, and/or statistical characteristics of the microphone audio signal as is well-known in the art of noise reduction. Optionally, further processing may be applied to the respective signals before input to the respective receivers 48, 48B, e.g. for hearing loss compensation of the respective signals.

Figure 2:
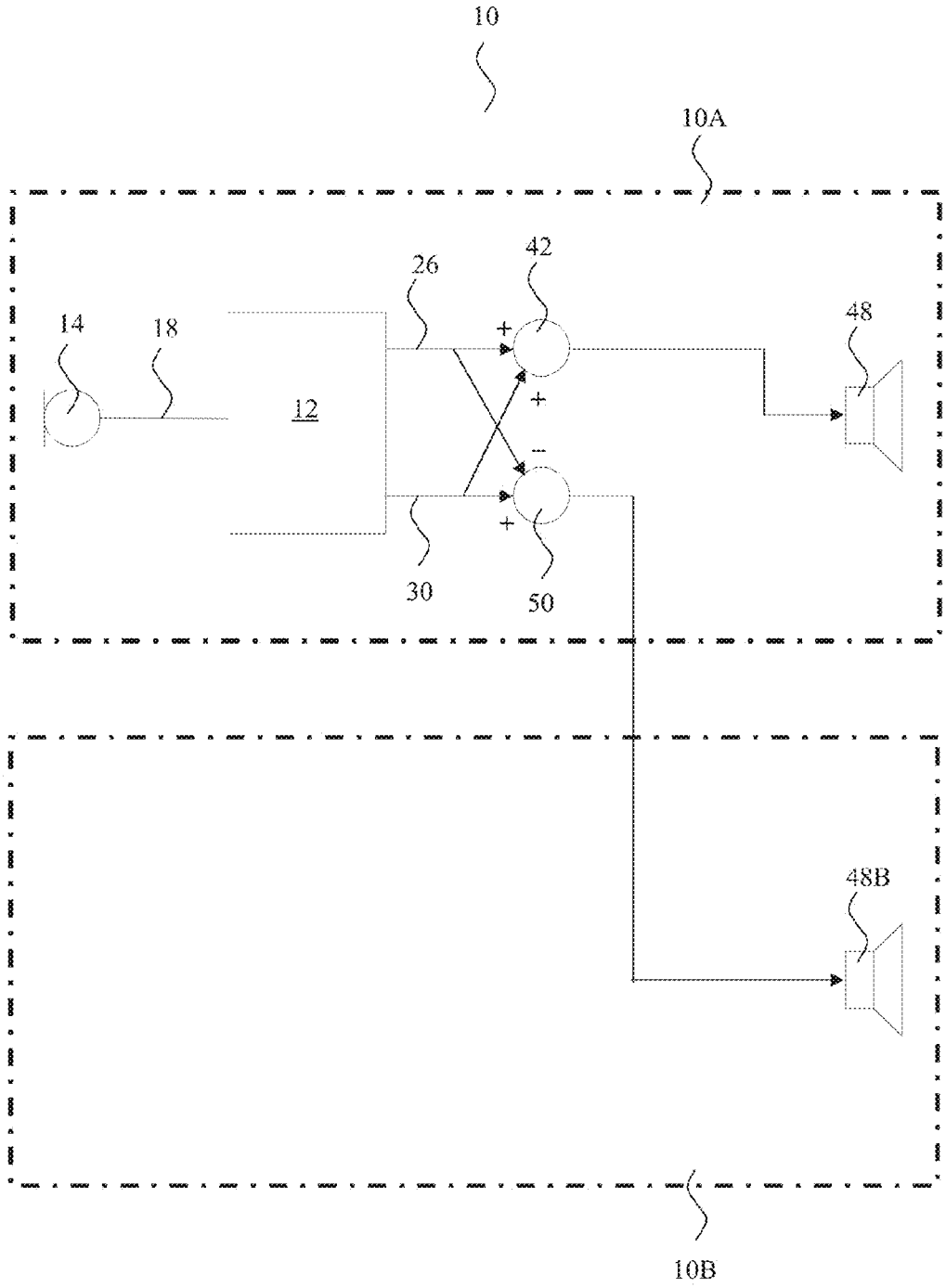

The new binaural hearing aid system (10) shown in FIG. 2 is similar to the hearing aid system shown in FIG. 1 except for the fact that the signal separation unit 12 shown in FIG. 2 is configured to provide both an estimate of the target signal 26 and an estimate of the noise signal 30 based on the possibly pre-filtered microphone audio signal 18.

The estimate of the target signal 26 is added to the estimate of the noise signal 30 in a first adder 42 and the output sum of the estimate of the target signal 26 and the estimate of the noise signal 30 is input to an output transducer 48 that converts the output of first adder 42 into an acoustic output signal that is transmitted towards the eardrum of the user wearing the binaural hearing aid system 10.

Further, the estimate of the target signal 26 is subtracted; corresponding to a phase shift of 180°, from the estimate of the noise signal 30 in a second adder 50, and the output of the second adder 50 is transmitted output transducer 48B for conversion into an acoustic output signal that is transmitted towards the other eardrum of the user wearing the binaural hearing aid system 10. In this way, the BMLD and SRT are improved.

The estimate of the target signal 26 and the estimate of the noise signal 30 may be swapped so that the estimate of the noise signal 20 is phase shifted 180° before presentation to one of the eardrums of the user instead of phase shifting the estimate of the target signal 26. The improvement in BMLD and SRT obtained in this way is smaller than the improvement obtained by phase shift of the estimate of the target signal 26.

Figure 3:
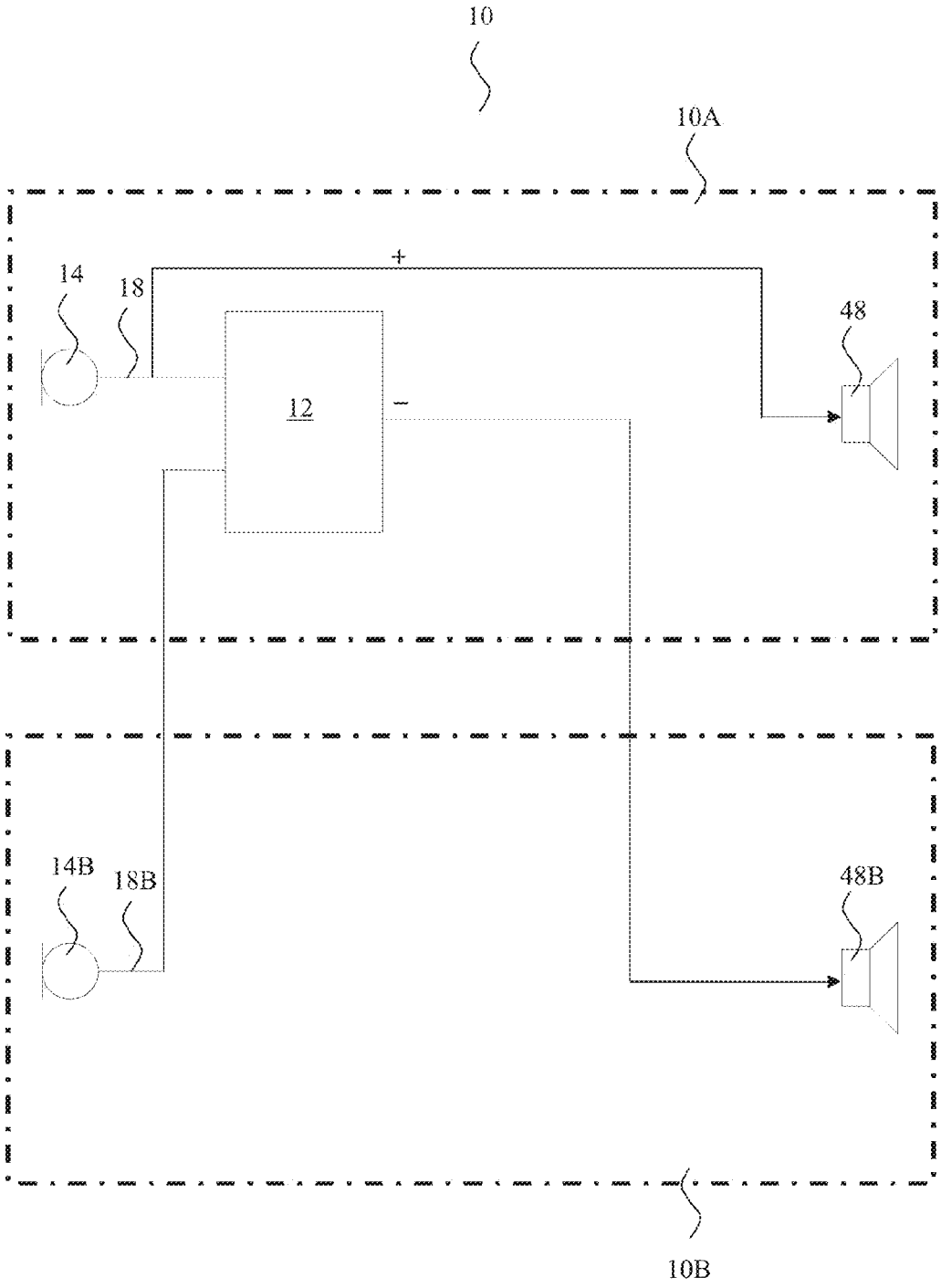

The new binaural hearing aid system (10) shown in FIG. 3 is similar to the hearing aid system shown in FIG. 1 except for the fact that a microphone audio signal 18B output by a microphone 14B in the second hearing aid 10B is transmitted by wired or wireless transmission to the first hearing aid 10A and input to the signal separation unit 12 so that the signal separation unit 12 can base the estimate of the target signal on both microphone audio signals 18, 18B, e.g. by beamforming as explained further below.

The relatively large distance between the microphones 14, 14B, when a user wears the first and second hearing aids 10A, 10B in their intended positions at the respective ears of the user, makes it possible to form a narrow beam and therefore allow a good spatial separation of the target signal from the noise signal.

Figure 4:
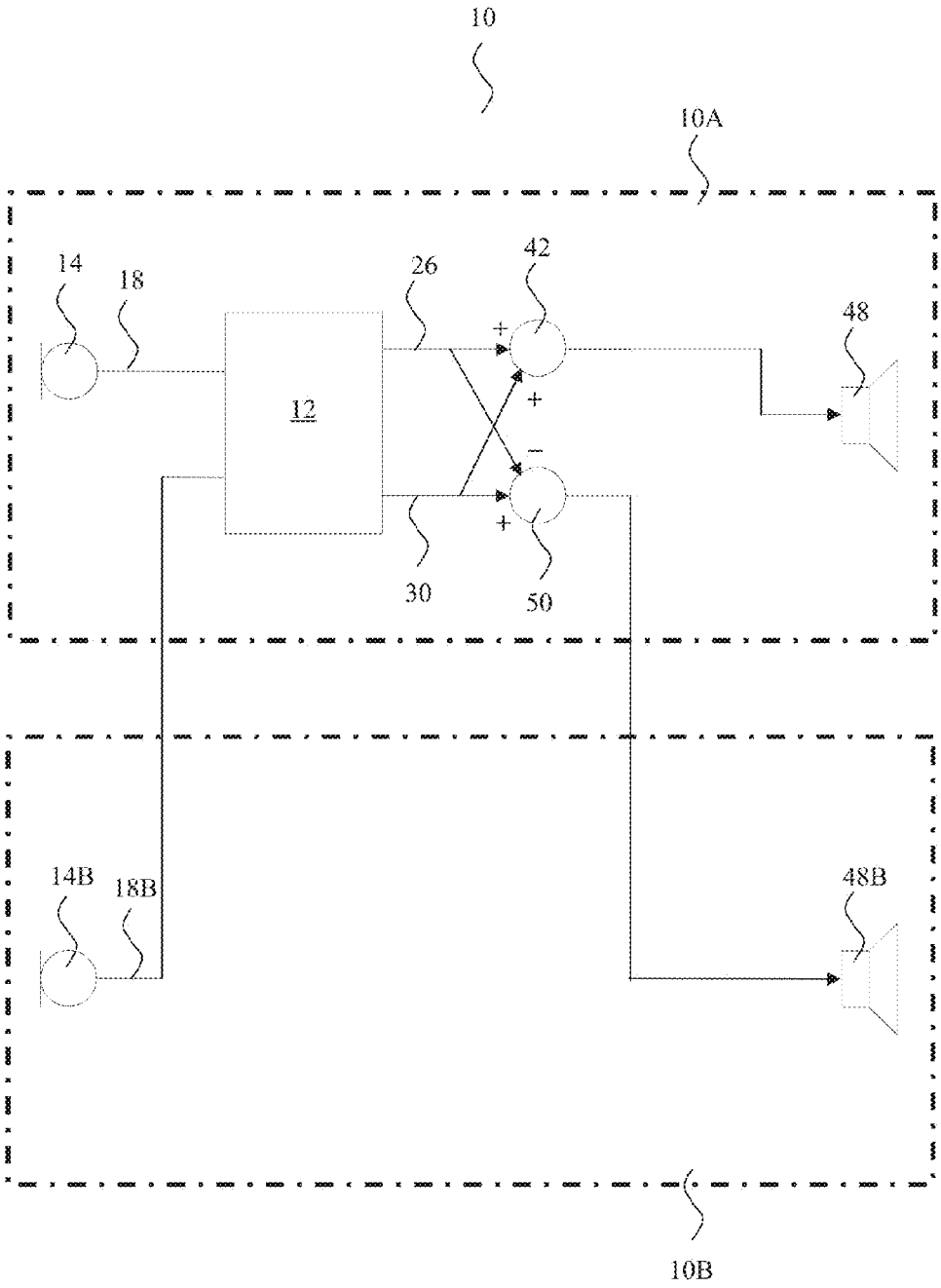

The new binaural hearing aid system (10) shown in FIG. 4 is similar to the hearing aid system shown in FIG. 3 except for the fact that the signal separation unit 12 shown in FIG. 4, like the signal separation unit shown in FIG. 2, is configured to provide both an estimate of the target signal 26 and an estimate of the noise signal 30 based on the possibly pre-filtered microphone audio signal 18.

The estimate of the target signal 26 is added to the estimate of the noise signal 30 in a first adder 42 and the output sum of the estimate of the target signal 26 and the estimate of the noise signal 30 is input to an output transducer 48 that converts the output of first adder 42 into an acoustic output signal that is transmitted towards the eardrum of the user wearing the binaural hearing aid system 10.

Further, the estimate of the target signal 26 is subtracted; corresponding to a phase shift of 180°, from the estimate of the noise signal 30 in a second adder 50, and the output of the second adder 50 is transmitted output transducer 48B for conversion into an acoustic output signal that is transmitted towards the other eardrum of the user wearing the binaural hearing aid system 10. In this way, the BMLD and SRT are improved.

Figure 5:
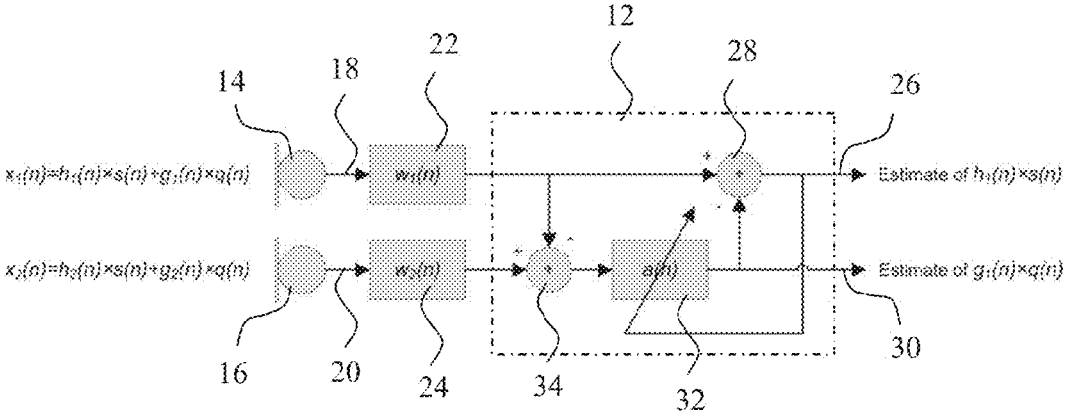

FIG. 5 schematically illustrates a digital signal separation unit 12 including an adaptive beamformer 10 with two microphones 14, 16.

The microphone audio signals 18, 20 are pre-filtered in conventional pre-filters 22, 24 before beamforming. The microphone audio signals 18, 20 may be digitized before or after the pre-filters 22, 24 by ND converters (not shown). Signals before and after pre-filtering and before and after analogue-digital conversion are all termed microphone audio signals.

The output 26 of first subtractor 28 generates the estimate of the target signal from the assumed target direction using adaptive beamforming. The estimate of the target signal 26 is subsequently presented to one of the two ears of the user and in opposite phase to the other of the two ears of the user. The output 30 of the adaptive filter 32 filtering the output of second subtractor 34 generates the noise estimate for subsequent presentation to both ears of the user.

The input $x_1(n)$ to the first microphone 14 is given by:

$$x_1(n)=h_1(n)*s(n)+g_1(n)*q(n)$$

where $h_1(n)$ is the impulse response of sound propagation from the source emitting the signal s(n) to the first microphone 14 and $g_1(n)$ is the impulse response of sound propagation from the noise source emitting the signal q(n) to the first microphone 14.

The input $x_2(n)$ to the second microphone 16 is given by:

$$x_2(n)=h_2(n)*s(n)+g_2(n)*q(n)$$

where $h_2(n)$ is the impulse response of sound propagation from the source emitting the signal s(n) to the second microphone 16 and $g_2(n)$ is the impulse response of sound propagation from the noise source emitting the signal q(n) to the second microphone 16.

Then, the output 26 of the target signal is equal to $h_1(n)*s(n)$, and the output 30 of the noise estimate is equal to $g_1(n)*q(n)$.

Figure 6:
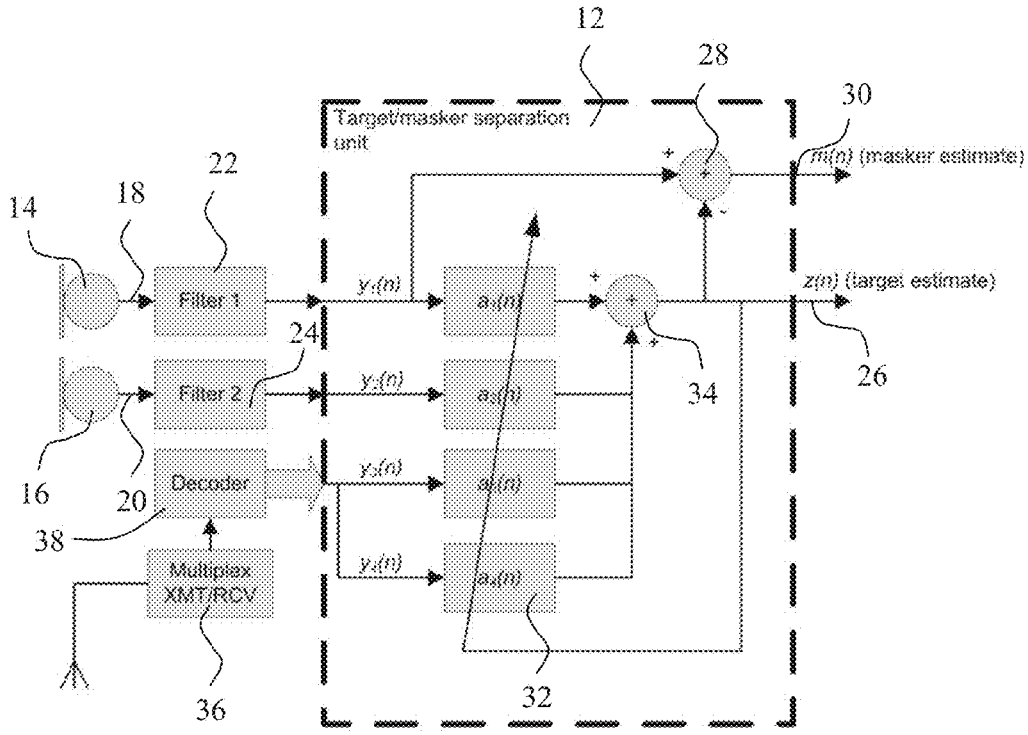

FIG. 6 schematically illustrates a signal separation unit 12 based on four microphones 22, 24, 22B, 24B, two of which 22, 24 are located in the first hearing aid 10A and other two of which 22B, 24B are located in the second hearing aid 10B.

The increased distance between the microphones may be utilized to form a directional pattern with a narrow beam providing improved spatial separation of the target estimate from the noise estimate. The conventional output of the beamformer may be used as the target estimate, and the noise estimate may be provided by subtraction of the target estimate from the microphone audio signal of one of the microphones in the plurality of microphones.

The microphone audio signals 18, 20 of the two microphones 22, 24 of the first hearing aid 10 are pre-filtered in respective pre-filters 22, 24 well-known in the art, into microphone audio signals $y_1(n)$, $y_2(n)$ and input to respective adaptive filters $a_1(n)$, $a_2(n)$.

The pre-filtered microphone audio signals of the two microphones 22B, 24B of the second hearing aid 10B are encoded for transmission in the second hearing aid 10B and transmitted to the first hearing aid 10A using wireless or wired data transmission. The transmitted data representing the microphone audio signals of the two microphones 22B, 24B of the second hearing aid 10B are received by the transceiver 36 of the first hearing aid 10A and decoded in decoder 38 into two microphone audio signals $y_3(n)$, $y_4(n)$ and input to respective adaptive filters $a_3(n)$, $a_4(n)$.

The adaptive filters $a_1(n)$, $a_2(n)$, $a_3(n)$, $a_4(n)$ are configured to filter the respective microphone audio signals $y_1(n)$, $y_2(n)$, $y_3(n)$, $y_4(n)$ and to adapt the respective filter coefficients for adaptive beamforming towards a sound source.

The adaptable filters $a_1(n)$, $a_2(n)$, $a_3(n)$, $a_4(n)$ make it possible to focus on a moving sound source or to focus on a non-moving sound source, while the user of the hearing aid system is moving. Furthermore, the adaptable filters $a_1(n)$, $a_2(n)$, $a_3(n)$, $a_4(n)$ are capable of adapting to changes in the sound environment, such as appearance of a new sound source, disappearance of a noise source or movement of noise sources relative to the user of the hearing aid system.

The adaptive beamformer filters $a_1(n)$, $a_2(n)$, $a_3(n)$, $a_4(n)$ are designed under the assumption that the signals received at the at least one microphone 14, 16, 14B, 16B can be modelled as a combination of a target signal from a pre-determined target direction plus noise:

$$y_i(n)=h_i(n)*s(n)+v_i(n)$$

where $h_i(n)$ is the impulse response of sound propagation from the source emitting the signal s(n) to the $i^{th}$ microphone and $v_i(n)$ is the noise signal at the same microphone. The noise can consist of both directional noise and other types of noise such as diffuse noise or babble noise.

The filter coefficients are adaptively be determined by solving the following optimization problem:

$$\{a_i(n)\}_{i=1}^{4} = \arg\min_{\{a_i(n)\}_{i=1}^{4}} \|z(n)\|^2$$

-continued $$\text{subject to } \sum_{i=1}^{4} a_i(n) * h_i(n) = h_1(n)$$

Filter adaptation is preferably performed using the least mean square (LMS) algorithm, more preferred the normalized least means square (NLMS) algorithm; however other algorithms may also be used, such as recursive least square, steepest descent or other types of numerical optimization algorithms.

The outputs of the adaptive filters $a_1(n)$, $a_2(n)$, $a_3(n)$, $a_4(n)$ are added in adder 34, and the output 26 of adder 34 constitutes the estimate of the target signal $$z(n) = h_1(n) * s(n).$$

Subtractor 28 outputs an estimate of the noise:

$$\widehat{v_1(n)} = y_1(n) - z(n).$$

Figure 7:
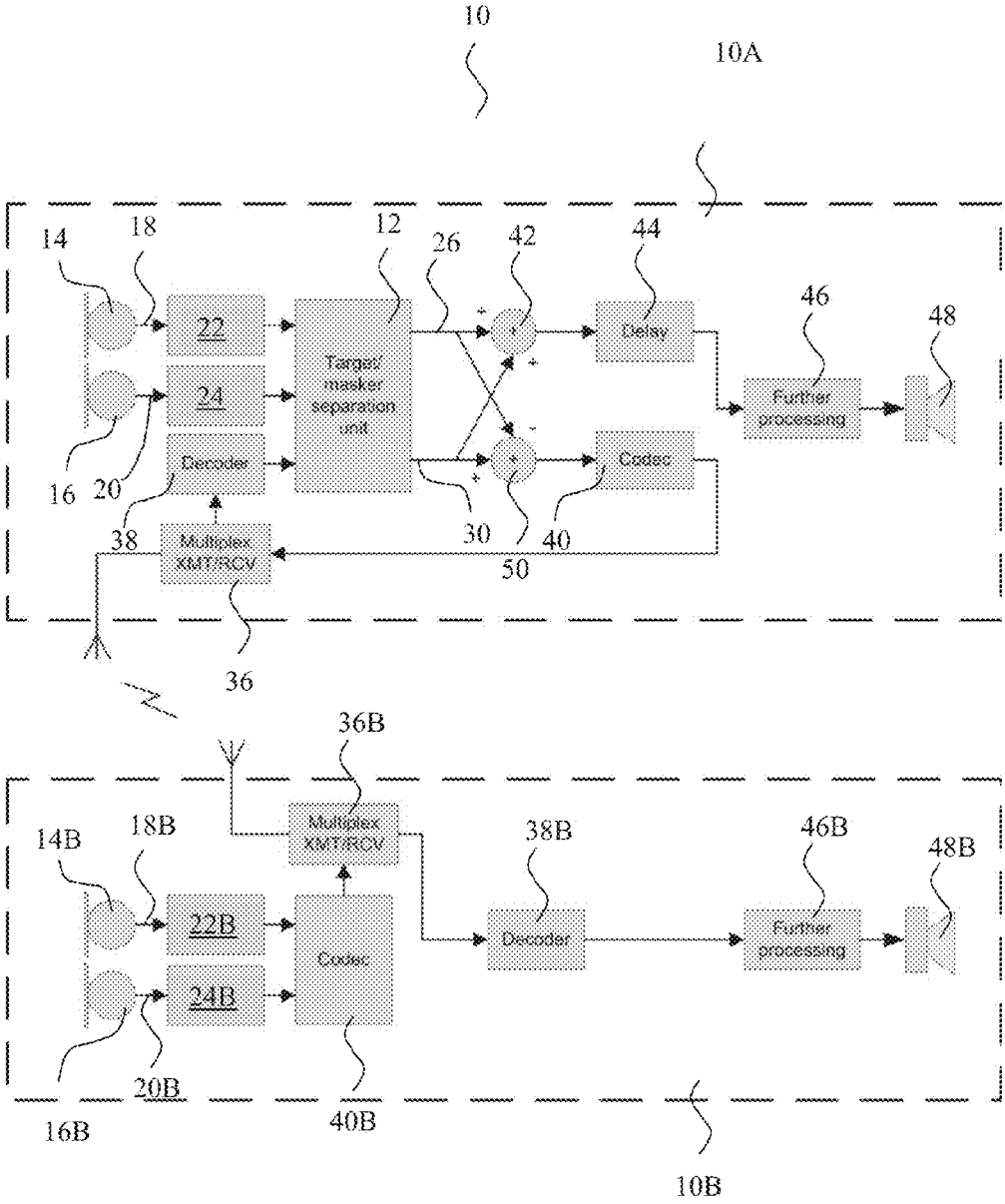

Once the target and noise estimate has been determined, the signals are presented to the user in such a way that the SRT of the user is improved as schematically illustrated in FIG. 7.

FIG. 7 shows an example of the new binaural hearing aid system 10.

The new binaural hearing aid system 10 has first and second hearing aids 10A, 10B with transceivers 36, 36B for data communication between the two hearing aids 10A, 10B. The first hearing aid 10A comprises at least one microphone with two microphones 14, 16 for provision of microphone audio signals 18, 20 in response to sound received at the respective microphones 14, 16. The microphone audio signals 18, 20 are pre-filtered in respective pre-filters 22, 24 well-known in the art, into microphone audio signals and input to the signal separation unit 12. The signal separation unit 12 is shown in more detail in FIG. 6 and explained above with reference to FIG. 6.

The second hearing aid 10B also comprises at least one microphone with two microphones 14B, 16B for provision of microphone audio signals 18B, 20B in response to sound received at the respective microphones 14B, 16B. The microphone audio signals 18B, 20B are pre-filtered by pre-filters 22B, 24B as is well-known in the art. Then the pre-filtered microphone audio signals of the two microphones 22B, 24B are encoded in Codec 40B for transmission to the first hearing aid 10A using wireless data transmission. The transmitted data representing the microphone audio signals of the second hearing aid 10B are received by the transceiver 36 of the first hearing aid 10A and decoded in decoder 38 into two microphone audio signals that are input to the signal separation unit 12 as explained above with reference to FIG. 6.

The signal separation unit 12 is configured to provide the estimate of the target signal 26 and the estimate of the noise signal 30 based on the pre-filtered microphone audio signals of the first and second hearing aids 10A, 10B.

The relatively large distance between the microphones of the individual hearing aids 10A, 10B as compared to the distance between microphones of a single hearing aid, makes it possible to configure the beamformer of the signal separation unit 12, see FIG. 6, with a narrow beam directional pattern providing improved spatial separation of the estimate of the target signal 26 from the estimate of the noise signal 30. The conventional output of the beamformer is used as the estimate of the target signal 26, and the estimate of the noise signal 30 is provided by subtraction of the estimate of the target signal 26 from the pre-filtered microphone audio signal of one of the microphones in the plurality of four microphones 14, 16, 14B, 16B.

Once the target and noise estimate has been determined, the signals are presented to the user in such a way that the SRT of the user is improved: The estimate of the target signal 26 is added to the estimate of the noise signal 30 in a first adder 42 and the output sum of the estimate of the target signal 26 and the estimate of the noise signal 30 is delayed in delay 44 and input to a signal processor 46 for hearing loss compensation. The delay 44 maintains the desired relative phase of the signals output by the first and second hearing aids 10A, 10B, respectively.

An output transducer 48, in the illustrated example a receiver 48, converts the output of the signal processor 46 into an acoustic output signal that is transmitted towards the eardrum of the user wearing the binaural hearing aid system 10.

Further, the estimate of the target signal 26 is subtracted; corresponding to a phase shift of 180°, from the estimate of the noise signal 30 in a second adder 50, and the output of the second adder 50 is encoded in Codec 40 for transmission by transceiver 36 to the second hearing aid 10B. In the second hearing aid 10B the transmitted sum is received by the transceiver 36B and decoded by decoder 38B and input to signal processor 46B for hearing loss compensation. An output transducer 48B, in the illustrated example a receiver 48B, converts the output of the signal processor 46B into an acoustic output signal that is transmitted towards the eardrum of the user wearing the binaural hearing aid system 10. In this way, the SRT of the user may be improved up to 20 dB depending on the sound environment.

The estimate of the target signal 26 and the estimate of the noise signal 30 may be swapped so that the estimate of the noise signal 20 is phase shifted 180° before presentation to one of the eardrums of the user instead of phase shifting the estimate of the target signal 26. The improvement in SRT obtained in this way is smaller than the improvement obtained by phase shift of the estimate of the target signal 26.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A binaural hearing aid system, comprising:

at least one microphone for provision of at least one microphone audio signal in response to sound received at the at least one microphone;

a signal separation unit configured to provide an estimate of one of a target signal and a noise signal based on the at least one microphone audio signal;

a phase shift circuit configured to phase shift the estimate;

a phase shift adder connected to provide a phase shifted signal, wherein the phase shifted signal is based at least in part on the phase shifted estimate of one of the target signal and the noise signal;

a first receiver for conversion of a first receiver input signal into a first acoustic signal for transmission towards a first eardrum of a user of the binaural hearing aid system; and a second receiver for conversion of a second receiver input signal into a second acoustic signal for transmission towards a second eardrum of the user;

wherein one of the first receiver input signal and the second receiver input signal represents the phase shifted signal, and the other one of the first receiver input signal and the second receiver input signal represents the sound received at the at least one microphone.

2. The binaural hearing aid system according to claim 1, further comprising:

a first hearing aid comprising a first microphone for provision of a first microphone audio signal in response to sound received at the first microphone; and a second hearing aid comprising a second microphone for provision of a second microphone audio signal in response to sound received at the second microphone;

wherein the at least one microphone comprises the first and second microphones, and the at least one microphone audio signal comprises the first and second microphone audio signals;

wherein the second hearing aid comprises a transceiver connected for transmission of signals to the first hearing aid, wherein the first hearing aid comprises a transceiver connected for reception of the signals from the second hearing aid, and wherein the signal separation unit is configured to provide the estimate of one of the target signal and the noise signal based on the first and second microphone audio signals of the first and second hearing aids, respectively.

3. The binaural hearing aid system according to claim 1, wherein the phase shift circuit phase shifts the estimate of the target signal.

4. The binaural hearing aid system according to claim 1, further comprising an in-phase adder connected to provide an in-phase sum of the estimate of the target signal and the estimate of the noise signal, wherein the signal representing the sound received at the at least one microphone is a signal representing an output of the in-phase adder.

5. The binaural hearing aid system according to claim 1, wherein the signal separation unit is configured to provide the estimate based on spectral characteristics of the at least one microphone audio signal.

6. The binaural hearing aid system according to claim 1, wherein the signal separation unit is configured to provide the estimate based on statistical characteristics of the at least one microphone audio signal.

7. The binaural hearing aid system according to claim 1, wherein the signal separation unit comprises a beamformer.

8. The binaural hearing aid system according to claim 7, wherein:

the at least one microphone comprises a first microphone of a first hearing aid and a second microphone of a second hearing aid;

the at least one microphone audio signal comprises a first microphone audio signal provided by the first microphone and a second microphone audio signal provided by the second microphone; and the beamformer is configured to provide the estimate based on the first and second microphone audio signals of the first and second hearing aids, respectively.

9. The binaural hearing aid system according to claim 7, wherein the beamformer comprises adaptive filters configured to filter the at least one microphone audio signal, and to adapt filter coefficients of the respective filters to minimize a sum of output signals of the filters.

10. The binaural hearing aid system according to claim 1, wherein the estimate is phase shifted by an amount that is anywhere from 150° to 210°.

11. A method of binaural signal enhancement in a binaural hearing aid system, the method comprising:

providing at least one microphone audio signal in response to sound;

providing an estimate of one of a target signal and a noise signal based on the at least one microphone audio signal;

phase shifting the estimate of one of the target signal and the noise signal;

providing a phase shifted signal based at least in part on the phase shifted estimate of one of the target signal and the noise signal;

transmitting a first signal representing the phase shifted signal towards a first eardrum of a user of the binaural hearing aid system; and transmitting a second signal representing the at least one microphone audio signal towards a second eardrum of the user.

12. The method of binaural signal enhancement according to claim 11, wherein the at least one microphone audio signal comprises microphone audio signals provided at both ears of the user in response to sound received at the ears, and the estimate of one of the target signal and the noise signal is provided based on the microphone audio signals at the ears.

13. The method of binaural signal enhancement according to claim 11, wherein the target signal is estimated and phase shifted.

14. The method of binaural signal enhancement according to claim 11, further comprising beamforming based on the at least one microphone audio signal.

15. The method of binaural signal enhancement according to claim 14, further comprising adaptive filtering of the at least one microphone audio signal by adapting filter coefficients to minimize a sum of adaptively filtered output signals.

16. The method of binaural signal enhancement according to claim 11, wherein the estimate is phase shifted by an amount that is anywhere from 150° to 210°.

17. The binaural hearing aid system of claim 1, wherein:

the estimate of one of the target signal and the noise signal comprises an estimate of the target signal, the phase shift circuit is configured to phase shift the estimate of the target signal, and the phase shifted signal is based on a combination of the noise signal and the phase shifted estimate of the target signal.

18. The binaural hearing aid system of claim 17, wherein:

the first receiver input signal represents the phase shifted signal that is based on the combination of the noise signal and the phase shifted estimate of the target signal; and the second receiver input signal is based on a combination of the noise signal and the target signal.

19. The binaural hearing aid system of claim 1, wherein:

the estimate of one of the target signal and the noise signal comprises an estimate of the noise signal, the phase shift circuit is configured to phase shift the estimate of the noise signal, and the phase shifted signal is based on a combination of the target signal and the phase shifted estimate of the noise signal.

20. The binaural hearing aid system of claim 19, wherein:

the first receiver input signal represents the phase shifted signal that is based on the combination of the target signal and the phase shifted estimate of the noise signal; and the second receiver input signal is based on a combination of the target signal and the noise signal.

21. The method of claim 11, wherein:

the estimate of one of the target signal and the noise signal comprises an estimate of the target signal, the act of phase shifting comprises phase shifting the estimate of the target signal, and the phase shifted signal is based on a combination of the noise signal and the phase shifted estimate of the target signal.

22. The method of claim 21, wherein:

the first signal represents the phase shifted signal that is based on the combination of the noise signal and the phase shifted estimate of the target signal; and the second signal is based on a combination of the noise signal and the target signal.

23. The method of claim 11, wherein:

the estimate of one of the target signal and the noise signal comprises an estimate of the noise signal, the act of phase shifting comprises phase shifting the estimate of the noise signal, and the phase shifted signal is based on a combination of the target signal and the phase shifted estimate of the noise signal.

24. The method of claim 23, wherein:

the first signal represents the phase shifted signal that is based on the combination of the target signal and the phase shifted estimate of the noise signal; and the second signal is based on a combination of the target signal and the noise signal.

* * * * *